United States Patent [19]

Martin et al.

[11] Patent Number: 4,539,134

[45] Date of Patent: Sep. 3, 1985

[54] METHODS AND CLEANING COMPOSITIONS FOR REMOVING ORGANIC MATERIALS FROM METALLIC SURFACES

[75] Inventors: Larry D. Martin, Al Khobar, Saudi Arabia; Paul S. Brown, Duncan, Okla.

[73] Assignee: Halliburton Company, Duncan, Okla.

[21] Appl. No.: 446,304

[22] Filed: Dec. 2, 1982

[51] Int. Cl.[3] ..... C11D 1/78

[52] U.S. Cl. ..... 252/156; 252/135; 252/174.17; 252/544; 252/DIG. 14; 252/DIG. 17

[58] Field of Search ..... 252/156, 174.16, DIG. 17, 252/135, 544, DIG. 14

[56] References Cited

U.S. PATENT DOCUMENTS

| | | | |
|---|---|---|---|
| Re. 28,014 | 5/1974 | Knieriem, Jr. | 8/142 |
| Re. 29,540 | 2/1978 | Randell et al. | 260/966 |
| 2,651,829 | 9/1983 | Nusslein | 28/72.3 |
| 3,010,907 | 11/1961 | Carroll | 252/135 |
| 3,030,239 | 4/1962 | Mekjean et al. | 252/156 |
| 3,294,693 | 12/1966 | Dupre et al. | 252/135 |
| 3,314,891 | 4/1967 | Schmolka | 252/89 |
| 3,661,960 | 5/1972 | Carlson | 252/DIG. 17 |
| 4,001,133 | 1/1977 | Sorgenfrei et al. | 252/156 |
| 4,139,487 | 2/1979 | Garrett | 252/182 |
| 4,140,647 | 2/1979 | Mizutani et al. | 252/156 |
| 4,175,051 | 11/1979 | Imamura et al. | 252/545 |
| 4,208,528 | 6/1980 | McClain | 528/487 |

FOREIGN PATENT DOCUMENTS

| | | |
|---|---|---|
| 0650839 | 1/1965 | Belgium . |
| 2812170 | 10/1978 | Fed. Rep. of Germany . |
| 0029563 | 3/1980 | Japan . |
| 1021391 | 3/1966 | United Kingdom . |

OTHER PUBLICATIONS

Chemical and Physical Properties of Alkyl Aryl Phosphates, H. R. Gamrath, Industrial and Engineering Chemistry, vol. 46, No. 1, pp. 208–212, Jan. 1954.

Chemistry of Organic Compound, Carl R. Noller, W. B. Saunders Company, Philadelphia and London, 1965.

Maphos 8135, Maphos Surfactant Mazor Chemical Inc., 1/83, 3938 Porett Drive, Gurnee, IL 60031.

GAFAC Surfactant, Technical Bulletin 7543-094, 1960, General Aniline & Film Corp., 140 W. 51 St., New York, N.Y. 10020.

*Primary Examiner*—Paul Lieberman

*Assistant Examiner*—Hoa Van Le

*Attorney, Agent, or Firm*—Thomas R. Weaver; Edward F. Sherer

[57] ABSTRACT

Methods and cleaning compositions are provided for more effectively removing oil, grease, paint, varnish and other organic coatings from metallic surfaces in industrial equipment, oil well tubular goods and the like. The metallic surfaces are contacted with a cleaning composition comprised of an aqueous solution of an alkaline material, a nonionic surface active agent and a wetting agent for a period of time sufficient to remove the organic materials therefrom. The nonionic surface active agent is an alkylarylpolyether alcohol having an ethylene oxide content in the range of from about 10 to about 13 units of ethylene oxide per molecule, and the wetting agent is selected from the group consisting of aromatic phosphate esters of the formulae:

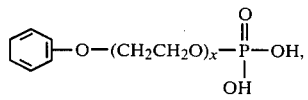

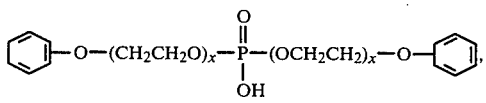

and

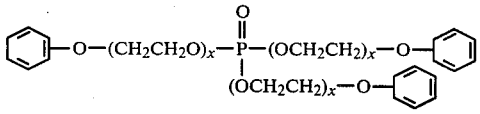

and mixtures of such phosphate esters wherein x has a value in the range of from about 4 to about 6.

8 Claims, No Drawings

METHODS AND CLEANING COMPOSITIONS FOR REMOVING ORGANIC MATERIALS FROM METALLIC SURFACES

Strongly alkaline aqueous cleaning compositions have been utilized heretofore for removing organic materials such as oil, grease, paint, varnish and the like from metallic surfaces in industrial equipment, oil well equipment and tubular goods. Alkaline compounds which have commonly been used are alkali metal and ammonium hydroxides, carbonates, bicarbonates, silicates, and phosphates and mixtures of such compounds.

The cleaning compositions have heretofore also included surface active agents, wetting agents, and various other additives such as sequestering agents, corrosion inhibitors, abrasives, etc. While such cleaning compositions have been used successfully in removing organic materials from surfaces, they generally must be heated to temperatures in the range of from about 150° F. to 210° F., or higher, to be effective. In industrial cleaning applications, the heating of cleaning compositions prior to or during use is often either impractical or impossible.

By the present invention improved methods and cleaning compositions for removing organic materials from metallic surfaces are provided. The effectiveness of the cleaning compositions of this invention, i.e., the cleaning power of the compositions, is greater than the heretofore used compositions, and as a result, the compositions can be utilized and remain effective at ambient temperatures.

The cleaning compositions of the present invention are comprised of aqueous solutions of alkaline materials, a specific nonionic surface active agent and a specific wetting agent. The alkaline materials which are suitable for use in accordance with the present invention are any of the materials commonly used in the cleaning industry or mixtures thereof. Examples of such alkaline materials are alkaline compounds and detergent builders such as alkali metal and ammonium hydroxides, carbonates, bicarbonates, silicates and phosphates, tetrasodium ethylenediamine-tetraacetic acid (EDTA), etc. Of the alkaline compounds, sodium hydroxide is the most widely used in cleaning compositions for removing oil, grease, paints, lacquers, varnishes and the like. The most commonly used detergent builders, i.e., ingredients that increase the detergent power of a surface active agent by acting as water softeners, sequestering agents and buffering agents, are the alkali metal silicates, alkali metal phosphates and tetrasodium EDTA.

The specific nonionic surfactant which is suitable for use in accordance with the present invention is selected from the group consisting of alkylarylpolyether alcohols or mixtures thereof having ethylene oxide contents in the range of from about 10 to about 13 units of ethylene oxide per molecule. The most preferred such nonionic surface active agent is nonylphenolethoxylate having an ethylene oxide content in the range of from about 12 to 13 units of ethylene oxide per molecule. The foregoing surface active agents lower the surface tension of aqueous cleaning compositions to below about 30 dynes per centimeter.

The specific wetting agent used in accordance with the present invention is an aromatic phosphate ester or mixture of aromatic phosphate esters selected from the group represented by the following formulae:

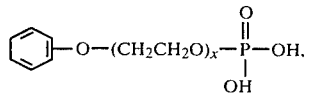

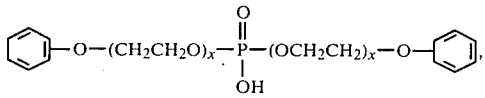

and

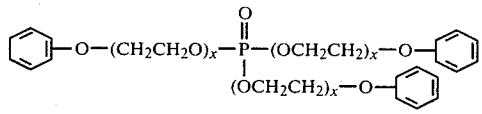

wherein x has a value in the range of from about 4 to about 6.

The most preferred wetting agent for use in accordance with this invention is a mixture of aromatic phosphate esters of the above formulae wherein x has an average value in the range of from about 4 to about 5, and most preferably an average value of about 4.6.

One preferred aqueous cleaning composition of the present invention is comprised of an aqueous solution of sodium hydroxide present in the composition in an amount in the range of from about 1% to about 3% by weight of the composition, trisodium phosphate present in the composition in an amount in the range of from about 0.05% to about 1% by weight of the composition, sodium metasilicate present in the composition in an amount in the range of from about 0.05% to about 1% by weight of the composition, nonylphenolethoxylate having an ethylene oxide content in the range of from about 12 to 13 units of ethylene oxide per molecule present in the composition in an amount in the range of from about 0.01% to about 0.1% by weight of the composition (most preferably 0.05%), and a mixture of the aromatic phosphate esters of the above structural formulae wherein x has an average value of about 4.6 present in the composition in an amount in the range of from about 0.01% to about 0.1% by weight of the composition (most preferably 0.05%).

The foregoing cleaning composition is suitable in general degreasing applications, particularly for the preoperational cleaning of boilers, tube oil systems, piping and the like.

In applications where the use of sodium hydroxide is undesirable, such as in cleaning feed water heaters, new boilers, etc., a particularly suitable and preferred cleaning composition of this invention is comprised of an aqueous solution of tetrasodium phosphate present in the composition in an amount in the range of from about 1% to about 2% by weight of the composition, nonylphenolethoxylate having an ethylene oxide content in the range of from about 12 to 13 units of ethylene oxide per molecule present in the composition in an amount of about 0.05% by weight of said composition, and a mixture of the phosphate esters of the structural formulae set forth above wherein x has an average value of about 4.6 present in the composition in an amount of about 0.05% by weight of the composition.

A preferred cleaning composition for removing oil or grease from oil well equipment and tubular goods is comprised of an aqueous solution of tetrasodium EDTA present in the composition in an amount in the range of from about 1% to about 4% by weight of the composition, nonylphenolethoxylate having an ethylene oxide content in the range of from about 12 to 13 units of ethylene oxide per molecule present in the composition in an amount of about 0.05% by weight of the composition, and a mixture of the aromatic phosphate esters of the formulae set forth above wherein x has an average value of about 4.6 present in the composition in an amount of about 0.05% by weight of the composition. The tetrasodium EDTA is used in this composition to provide alkalinity and to complex calcium and magnesium ions contained in formation water which may be encountered in cleaning oil well equipment to prevent precipitates formed therefrom.

In carrying out the methods of the present invention using the preferred cleaning compositions described above, the compositions can be utilized at ambient temperatures, but are preferably heated to a temperature in the range of from about 180° F. to 220° F. to increase the efficiency of the methods. The metallic surfaces from which oil, grease or other organic materials are to be removed are contacted with the cleaning compositions for periods of time sufficient to remove the organic materials. As will be understood by those skilled in the art, the contact can be static or dynamic, but is preferably dynamic.

A preferred cleaning composition of the present invention for use in any application where it is desirable that the composition be neutral and it is impractical or impossible to heat the composition in an aqueous solution of monosodium phosphate present in the composition in an amount in the range of from about 1% to about 2% by weight of the composition, disodium phosphate present in the composition in an amount in the range of from about 1% to about 2% by weight of the composition, nonylphenolethoxylate having an ethylene oxide content in the range of from about 12 to 13 units per molecule present in the composition in an amount of about 0.05% by weight of the composition, and a mixture of the above-identified aromatic phosphate esters wherein x has an average value of about 4.6 present in the composition in an amount of about 0.05% by weight of the composition.

In order to facilitate a clear understanding of the methods and compositions of the present invention, the following example is given.

EXAMPLE

Steel test panels (3"×3") are precleaned using the following procedure:

(1) Soak panels in carbon tetrachloride for 5 minutes.
(2) Wipe the surface of each panel with a cloth wetted with $CCl_4$, then rinse the panel with fresh $CCl_4$.
(3) Shake off excess solvent and immerse the panels in methanol for 5 minutes.
(4) Shake off excess solvent and immerse in deionized water for 5 minutes.
(5) Remove the panels and examine them for water-break (easily visible droplets caused by unclean areas).
(6) Panels showing no water-break after 5 seconds are immersed successively in two beakers of acetone, air dried 5 minutes, and dried 10 minutes at 80° C.
(7) Store under vacuum until needed.

The test panels are coated with crude oil by immersing them in a beaker of crude oil and then allowing the coated panels to drain for approximately 60 minutes. Four crude oils are used identified as Symer Clearfork, ARCO Holt Sand, Fullerton Clearfork and Adair #1 Crude.

The following procedure is followed for determining the effectiveness of various cleaning compositions in removing the crude oil from the steel test panels.

(1) Suspend each crude oil coated test panel in the cleaning composition to be tested. The test panel is connected to a variable speed motor and the cleaning composition is contained in a vat and is heated to a temperature of 90° C. (Tables I and II) or the cleaning composition is not heated and the tests are carried out at ambient temperature, i.e., approximately 21° C. (Tables III and IV).
(2) Rotate each panel for 5 minutes in the cleaning composition at 30 RPM, then rinse it in an overflowing beaker of warm water (40° C.) for 1 minute. Remove the panel and drain it in the air for 20 seconds.
(3) Spray the panel lightly with deionized water for about 10 seconds on each side (use a Windex bottle). The spray condenses on any part of the surface where oil remains to form discrete, easily visible droplets called water-break. A continuous film of water is observed over clean areas.
(4) Report the cleaning efficiency as the percent of the 3"×3" test area that shows no water-break.

The cleaning compositions tested are aqueous solutions containing alkaline compounds comprised of EDTA and ammonium hydroxide or tetrasodium EDTA. Each composition also contains a wetting agent comprised of a mixture of aromatic phosphate esters of the structural formulae:

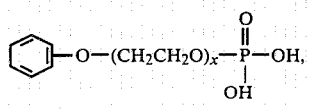

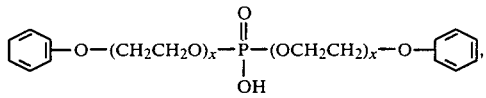

and

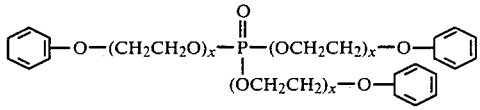

wherein x has an average value of about 4.6, and one of the following nonionic surface active agents:

| Surface Active Agent Description | Designation in Tables |
|---|---|
| Polyethylene glycol ether of linear alcohol | A |
| 80% (by weight) straight chain ethoxylated alcohol approximately 10% water and approximately 10% methanol. The ethylene oxide content in the range of from about 5 to about 6 | B |
| 15% (by weight) water, 35% ethanol, 25% octylphenoxypolyethoxyethanol with an average ethylene oxide content in the range of from about 7 to about 8, and 25% sodium salt of an amphoteric surfactant | C |
| Nonylphenolethoxylate having an ethylene oxide content | D |

-continued

| Surface Active Agent Description | Designation in Tables |
|---|---|
| in the range of from about 12 to 13 units of ethylene oxide per molecule | |

The results of these tests are given in Tables I through IV below.

TABLE I

Degreasing Steel Panels Coated with ARCO Sand Unit Crude @ 90° C. Aqueous Cleaning Composition Components[1]

| Nonionic Surface Active Agent | Wetting Agent | Alkaline Compounds | % Oil Removed From Panels |
|---|---|---|---|
| 0.05 wt. % A | 0.05 wt. % | 2 wt. % EDTA 5 Vol % $NH_4OH$ | 90 |
| 0.05 wt. % A | 0.05 wt. % | 4 wt. % $Na_4EDTA$ | 95 |
| 0.05 wt. % B | 0.05 wt. % | 4 wt. % $Na_4EDTA$ | 60 |
| 0.05 wt. % C | 0.05 wt. % | 4 wt. % $Na_4EDTA$ | 25 |
| 0.05 wt. % D | 0.05 wt. % | 4 wt. % NaEDTA | 100 |
| 0.05 wt. % D[2] | 0.05 wt. % | 4 wt. % NaEDTA | 100 |

[1]Degreasing solutions were made up with 10% ARCO Sand Unit Formation water added to each.
[2]0.1% WS-36 (mixture of an ethylene oxide derivative of a fatty acid and a sorbital reaction product)

TABLE II

Degreasing Steel Panels Coated with Symer Clearfork Crude @ 90° C. Aqueous Cleaning Composition Components[1]

| Nonionic Surface Active Agent | Wetting Agent | Alkaline Compounds | % Oil Removed From Panels |
|---|---|---|---|
| 0.05 wt. % A | 0.05 wt. % | 2 wt. % EDTA 5 Vol % $NH_4OH$ | 95 |
| 0.05 wt. % B | 0.05 wt. % | 2 wt. % EDTA 5 Vol % $NH_4OH$ | 75 |
| 0.05 wt. % C | 0.05 wt. % | 2 wt. % EDTA 5 Vol % $NH_4OH$ | 20 |
| 0.05 wt. % A | 0.05 wt. % | 4 wt. % $Na_4EDTA$ | 99 |
| 0.05 wt. % B | 0.05 wt. % | 4 wt. % $Na_4EDTA$ | 50 |
| 0.05 wt. % C | 0.05 wt. % | 4 wt. % $Na_4EDTA$ | 20 |
| 0.05 wt. % D | 0.05 wt. % | 2 wt. % EDTA 5 Vol % $NH_4OH$ | 90 |
| 0.05 wt. % D | 0.05 wt. % | 4 wt. % $Na_4EDTA$ | 99 |

[1]Degreasing solutions were made up with 10% ARCO Sand Unit Formation water added to each.

TABLE III

Degreasing Panels Coated with Adair #1 Crude @ Ambient Temperature Aqueous Cleaning Composition Components[1]

| Nonionic Surface Active Agent | Wetting Agent | Alkaline Compounds | % Oil Removed From Panels |
|---|---|---|---|
| 0.05 wt. % A | 0.05 wt. % | 2 wt. % EDTA 5 Vol % $NH_4OH$ | 70 |
| 0.05 wt. % A | 0.05 wt. % | 4 wt. % $Na_4EDTA$ | 50 |
| 0.05 wt. % B | 0.05 wt. % | 4 wt. % $Na_4EDTA$ | 70 |
| 0.05 wt. % C | 0.05 wt. % | 4 wt. % $Na_4EDTA$ | 90 |
| 0.05 wt. % D | 0.05 wt. % | 4 wt. % NaEDTA | 95 |
| 0.05 wt. % D[2] | 0.05 wt. % | 4 wt. % NaEDTA | 95 |

[1]Degreasing solutions were made up with 10% of a solution containing 2 wt. % potassium chloride.
[2]0.05% WS-36 added to this test.

TABLE IV

Degreasing Panels Coated with Fullerton Clearfork Crude @ Ambient Temperature Aqueous Cleaning Composition Components[1]

| Nonionic Surface Active Agent | Wetting Agent | Alkaline Compounds | % Oil Removed From Panels |
|---|---|---|---|
| 0.05 wt. % A | 0.05 wt. % | 2 wt. % EDTA 5 Vol % $NH_4OH$ | 50 |
| 0.05 wt. % B | 0.05 wt. % | 2 wt. % EDTA 5 Vol % $NH_4OH$ | 30 |
| 0.05 wt. % C | 0.05 wt. % | 2 wt. % EDTA 5 Vol % $NH_4OH$ | 10 |
| 0.05 wt. % A | 0.05 wt. % | 4 wt. % $Na_4EDTA$ | 40 |
| 0.05 wt. % B | 0.05 wt. % | 4 wt. % $Na_4EDTA$ | 40 |
| 0.05 wt. % C | 0.05 wt. % | 4 wt. % $Na_4EDTA$ | 20 |
| 0.05 wt. % D | 0.05 wt. % | 2 wt. % EDTA 5 Vol % $NH_4OH$ | 50 |
| 0.05 wt. % D | 0.05 wt. % | 4 wt. % $Na_4EDTA$ | 80 |

[1]Degreasing solutions were made up with 10% of a solution containing 2 wt. % potassium chloride.

From Tables I through IV it can be seen that the most effective cleaning compositions are those containing nonylphenolethyloxylate (nonionic surface active agent) having an ethylene oxide content in the range of from about 12 to 13 ethylene oxide units per molecule and a wetting agent comprised of a mixture of aromatic phosphate esters.

What is claimed is:

1. A method of removing oil, grease and other organic materials from metallic surfaces comprising:

contacting said metallic surfaces for a period of time sufficient to remove the materials with an aqueous composition comprising:

(a) an alkaline material selected from the group consisting of alkali metal hydroxide, ammonium hydroxide, an alkali metal carbonate, an alkali metal silicate, an alkali metal phosphate, tetrasodium EDTA and mixtures thereof;

(b) a wetting agent selected from the group consisting of aromatic phosphate esters of the formulae:

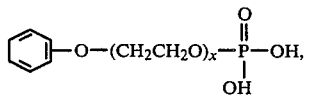

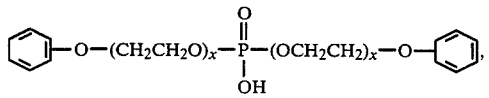

and

-continued

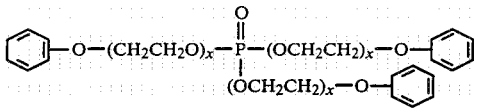

and mixtures of such phosphate esters wherein x has a value in the range of from about 4 to about 6; and, (c) a nonionic surface active agent comprising nonylphenolethoxylate havng an ethylene oxide content in the range of from about 12 to about 13 units of ethylene oxide per molecule.

2. The method of claim 1 wherein said wetting agent is a mixture of said aromatic phosphate esters and x has an average value in the range of from about 4 to 5.

3. The method of claim 1 wherein said alkaline material is present in said composition in an amount in the range from about 1% to about 5% by weight of said composition.

4. The method of claim 1 wherein said nonionic surface active agent is present in said composition in an amount in the range of from about 0.01% to about 0.1% by weight of said composition.

5. The method of claim 1 wherein said wetting agent is present in said composition in an amount in the range of from about 0.01% to about 0.1% by weight of said composition.

6. The method of claim 1 wherein said alkaline material is comprised of sodium hydroxide present in said composition in an amount in the range of from about 1% to about 3% by weight of said composition, trisodium phosphate present in said composition in an amount in the range from about 0.05% to about 1% by weight of said composition, and sodium metasilicate present in said composition in an amount in the range of from about 0.05% to about 1% by weight of said composition, the nonionic surface active agent is present in said composition in an amount of about 0.05% of said composition, and the wetting agent is a mixture of aromatic phosphate esters having the formulae:

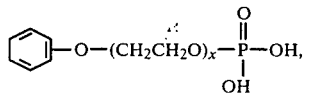

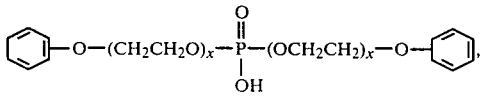

and

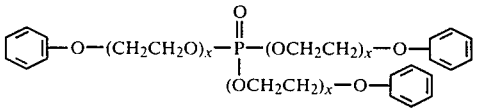

wherein x has an average value of about 4.6 and is present in said composition in an amount of about 0.5% by weight of said composition.

7. The method of claim 1 wherein said alkaline material is comprised of trisodium phosphate and is present in said composition in the range of from about 1% to about 2% by weight of said composition, the nonionic surface active agent is present in said composition in an amount of about 0.05% by weight of said composition, and the wetting agent is a mixture of aromatic phosphate esters of the formulae:

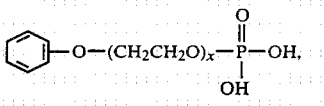

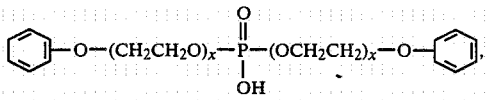

and

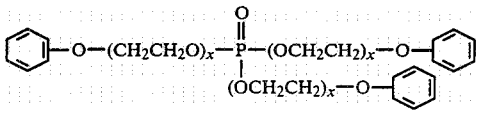

wherein x has an average value of about 4.6 present in said composition in an amount of about 0.05% by weight of said composition.

8. The method of claim 1 wherein the alkaline material is tetrasodium EDTA present in said composition in an amount in the range of from about 1% to about 4% by weight of said composition, the nonionic surface active agent is present in said composition in an amount of about 0.05% by weight of said composition, and the wetting agent is a mixture of aromatic phosphate esters of the formulae:

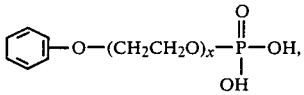

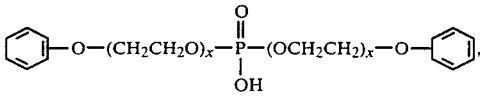

and

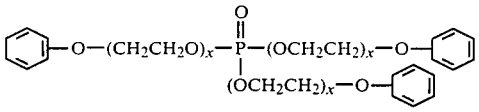

wherein x has an average value of about 4.6 and is present in said composition in an amount of about 0.05% by weight of said composition.

* * * * *